US006655258B2

(12) United States Patent
Park

(10) Patent No.: US 6,655,258 B2
(45) Date of Patent: Dec. 2, 2003

(54) RODLESS CYLINDER USING A ROUND STICK TYPE CHAIN

(75) Inventor: Oe Sook Park, Pusan (KR)

(73) Assignee: Fine Tech Corporation, Jeonbuk (KR)

( * ) Notice: Subject to any disclaimer, the term of this patent is extended or adjusted under 35 U.S.C. 154(b) by 0 days.

(21) Appl. No.: 10/176,627

(22) Filed: Jun. 24, 2002

(65) Prior Publication Data

US 2003/0106428 A1 Jun. 12, 2003

(30) Foreign Application Priority Data

Dec. 7, 2001 (KR) ..... 2001-37846

(51) Int. Cl.[7] ..... F15B 15/26
(52) U.S. Cl. ..... 92/137; 474/220
(58) Field of Search ..... 92/137, 161, 163; 474/111, 140, 220

(56) References Cited

U.S. PATENT DOCUMENTS 4,694,733 A * 9/1987 Green ..... 92/137
5,016,519 A * 5/1991 Goedecke et al. ..... 92/137
5,035,171 A * 7/1991 Gottling et al. ..... 92/137
5,040,332 A * 8/1991 Aquilina ..... 92/88
5,148,631 A * 9/1992 Bayard et al. ..... 49/449
5,222,428 A * 6/1993 Janetzko et al. ..... 92/137

* cited by examiner

*Primary Examiner*—Edward K. Look
*Assistant Examiner*—Thomas E. Lazo
(74) *Attorney, Agent, or Firm*—Greenblum & Bernstein, P.L.C.

(57) ABSTRACT

A rodless cylinder using a round stick type chain can be applied to a carrier for transportation of materials. The rodless cylinder uses a round stick type chain having the round stick type chain and the chain sprocket, which serve to guide the round stick type chain in a caterpillar form. The chain sprocket is axially formed on either side of the frame consisting of the rodless cylinder to install the round stick type chain in a caterpillar form. Both sides of the round stick type chain are connected to a piston within the cylinder on the frame and to a tension adjustment nut on the connector, respectively. The connector is guided to the guide bar formed between the frame vertically and selectively linked to the carrier.

1 Claim, 3 Drawing Sheets

RODLESS CYLINDER USING A ROUND STICK TYPE CHAIN

BACKGROUND OF THE INVENTION

1. Field of the Invention

This invention relates to a rodless cylinder using a round stick type chain and more particularly, to the rodless cylinder using a round stick type chain, wherein it can be applied to an elevator or a carrier for horizontal movement for the efficient transportation of materials in the industrial fields with better durability and safety of rodless cylinder, as well as the cost-saving effects in manufacture.

A rodless cylinder with various types designed to distribute the materials has been extensively used in the industrial field, but the conventional rodless cylinder has recognized some disadvantages in that their poor tensile strength proven to be inadequate for the use of an industrial elevator or carrier due to lower durability during the long-term use. Moreover, a cable-shaped with a limited diameter of cable wire is restricted in use due to the weight limitedness of transport materials.

Another conventional magnetic-shaped rodless cylinder has been used for the transportation of light weight materials depending on the indirect transportation method, but it cannot be applied to a vertically- moving elevator.

Under such circumstances, there is an urgent need for the development of an efficient driving means to be applicable to the conventional elevator and a carrier for horizontal movement.

SUMMARY OF THE INVENTION

To overcome the various problems that the conventional rodless cylinder has faced, therefore, an object of this invention is to provide a rodless cylinder using a round stick type chain with the following advantages: 1 better rigidity and tensile strength to replace the conventional rodless cylinder, 2 simultaneous use of both mid-weight material and movement direction, and 3 economical effect in purchase due to a simple structure.

Figure 1:
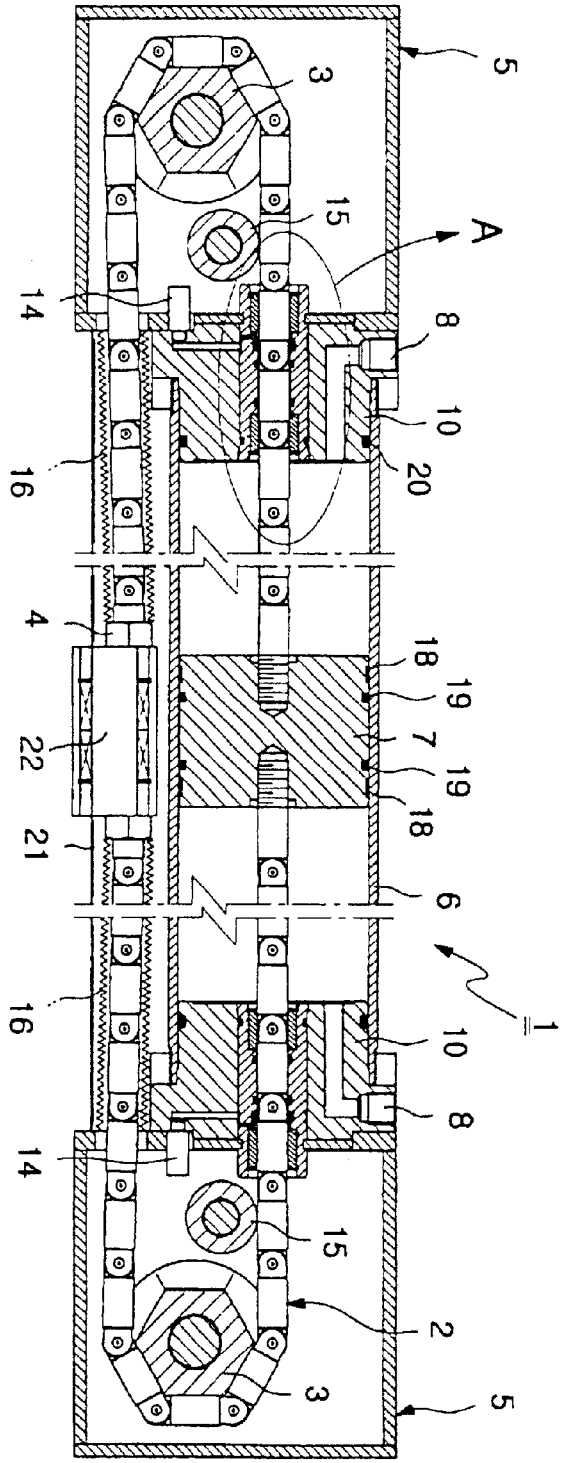
FIG. 1 is a sectional view of the whole structure showing one preferred embodiment of this invention.

Explanation of the main codes represented in the drawings

| | |
|---|---|
| 1: | Rodless cylinder of round stick type chain |
| 2: | Round-stick type chain |
| 3: | Chain sprocket |
| 4: | Tension adjustment nut |
| 5: | Frame |
| 6: | Cylinder |
| 7: | Piston |
| 8: | Air inlet |
| 9: | Emerging hole |
| 10: | Cylinder cap |
| 11: | Chain guide |
| 12: | Dust seal |
| 13: | Packing |

-continued

| | |
|---|---|
| 14: | Exhaust silencer |
| 15: | Chain guide roller |
| 16: | Zebra-shaped cover |
| 21: | Guide bar |
| 22: | Connector |

DETAILED DESCRIPTION OF THE INVENTION

Figure 2:
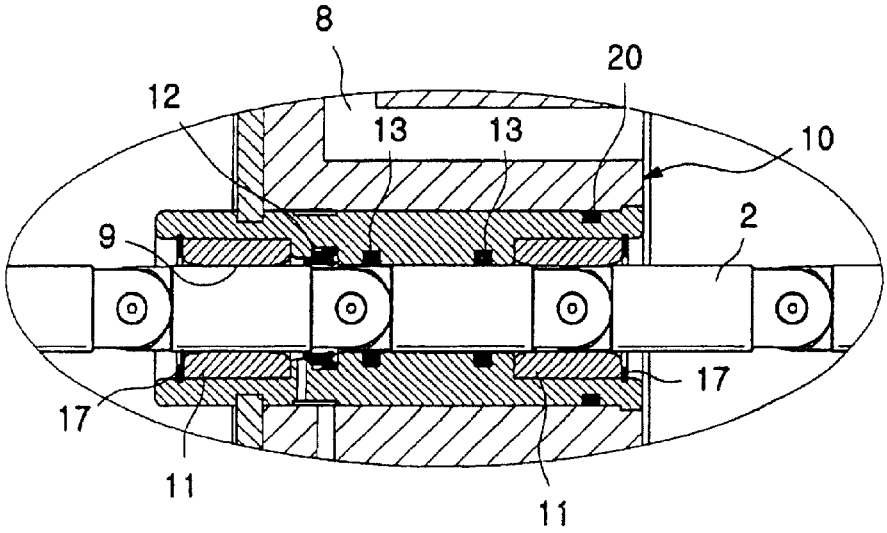
FIG. 2 is a sectional view expanding 'A part' of this invention.
Figure 3:
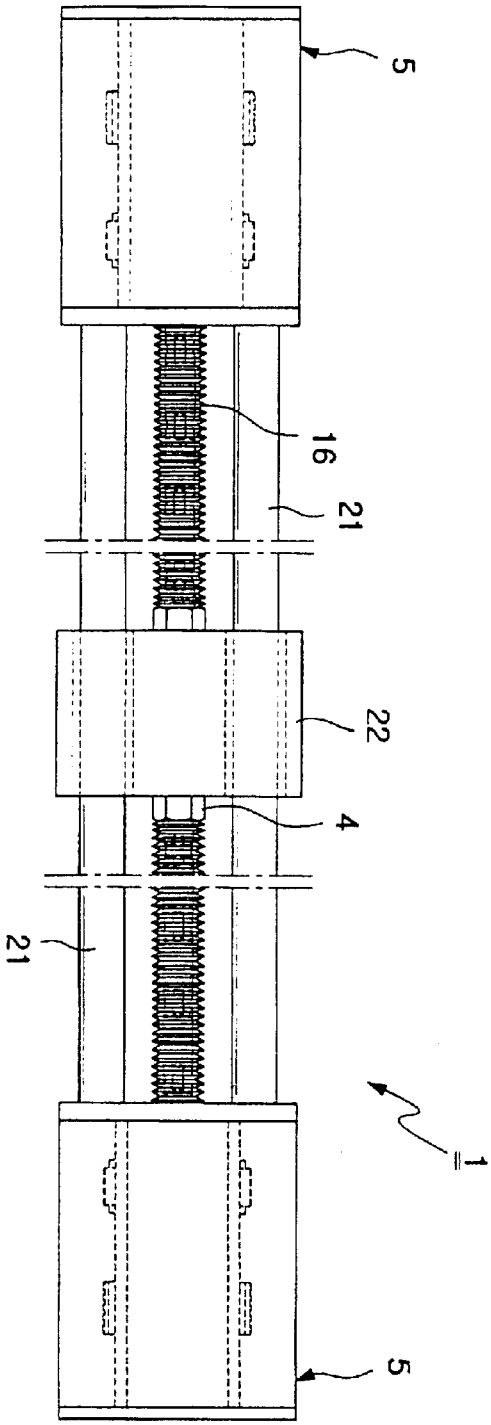
FIG. 3 is a bottom plan view of this invention

FIG. 1 is a sectional view of the whole structure showing one preferred embodiment of this invention FIG. 2 is a sectional view expanding 'A part' of this invention. FIG. 3 is a partial cut way perspective view of the rodless cylinder using a round stick type chain 1 according to this invention.

This invention is explained in detail by accompanying these drawings.

According to this invention, a rodless cylinder of a round stick type chain 1 is characterized by using a round stick type chain 2 for its structure, provided that the detailed description on the structures of both a round stick type chain 2 and a chain sprocket 3 in which the chain 2 is equipped with caterpillar form, since these structures (utility design No. 248087) was already registered in the Korean Industrial Property Office through the application of the inventor.

With an encounter of the frame 5 constituting the rodless cylinder of a round stick type chain 1, the chain sprocket 3 in a chain gear form, which is intended for guiding the round stick type chain 2 in a caterpillar form is axially installed within the cylinder.

The round stick type chain 2 and chain sprocket 3 may be installed in more than one place, and the illustrated example represents the round stick type chain 2 in a line.

The middle part of the round stick type chain 2 is connected with a connector 22 where a tension adjustment nut 4 is jointed with a bolt; the other part of the round stick type chain 2 is connected with a piston 7 where a shuttle movement is made available through air flow within the inside of a cylinder 6 formed in the frame 5.

An air inlet 8 is formed on either side of cylinder cap 10 from the cylinder 6, and either side of the cylinder 6 supplies the air alternatively from an air compressor (non-illustrated), thus inducing the piston 7 to make its shuttle movement from side to side or vertically depending on the installed direction.

An emerging hole 9 is formed on the cylinder 10 which is connected to both end-sides of the cylinder 6 and the round stick type chain 2 may be emerged may be emerged in the emerging hole 9. Also, a chain guide 11 designed to guide the emerging round stick type chain 2 is formed on either side of the emerging hole 9; the inside of chain guide 11 comprises a dust seal 1 and tightness, respectively.

Further, an exhaust silencer 14 is formed at the side of the cylinder cap 100, so as to exhaust the remaining air within the emerging hole 9.

In an effort to guide and support the round stick type chain 2 emerging in the cylinder cap 100, a chain guide roller 15 is formed at either side of the frame. The outer side of the round stick type chain 2, which passes through the corresponding part of the cylinder 6 is covered with a zebra-shaped cover 16, so as to prevent the input of any foreign materials.

A connector 22, which is connected to the tension adjustment nut 4, which is connected to both end sides of the round stick type chain 2, is connected by a guide bar 21 formed between the frame 5 and to an elevator or a carrier for the transportation of materials.

The code 17 in the drawing denotes a stop ring to fix the chain guide 11; the code 18 denotes a wearing for the piston 7; the code 19 denotes a packing for the piston 7; and, the code 20 denotes O-ring formed on the cylinder cap 10.

As such, the rodless cylinder using a round stick type chain 1 of this invention may be used as a driving means to drive an elevator or carrier for horizontal movement in the industrial fields. Hence, this invention describes the detailed procedures of the rodless cylinder using a round stick type chain 1 as set forth hereunder.

(1) An elevator or carrier is selectively connected to the connector 22 where both sides of the round stick type chain 2 is connected by the tension adjustment nut.

(2) Then, the air compressor is connected to the air inlet 8 at both sides of the cylinder 6 to supply the air on either side alternatively; then, the piston 7 is moved towards the other direction by the air supplied form the air inlet 8 on one side.

(3) The round stick type chain 2 in a caterpillar form, which is connected to both sides of the piston 7, is moving via the emerging hole 9 on the cylinder cap 10 and thus, an elevator or carrier, which is linked to the connector 22 formed at the middle part of the round stick type chain 2, may make its shuttle driving vertically or from side to side.

The driving direction and speed of the round stick type chain 2 is determined depending on the air direction of air inlet 8 formed on the cylinder cap 10 on either side of the cylinder 6. The length of the round stick type chain 2, namely, the full length of the rodless cylinder 1 may be optionally adjusted in accordance with the transportation stroke of an elevator or carrier.

When the round stick type chain 2 is operated on the cylinder 6, the remaining air in the emerging hole 9 is efficiently exhausted via the exhaust silencer 14, thus preventing the operation defects due to the remaining air in advance.

The chain guide 11 at the front and rear of the emerging hole 9 can efficiently guide the entry of the round stick type chain 2, while the dust seal 12 functions to prevent any foreign materials into the cylinder 6 in advance.

This invention is characterized by the components of the round stick type chain 2 and the polygonal chain sprocket 3 which serves to guide the round stick type chain 2, thus extending the expected life span of the rodless cylinder using a round stick type chain through its efficient driving with a combination of excellent properties such as tightness and tensile strength.

As described above, the rodless cylinder using a round stick type chain 1 of this invention is intended for the use as a driving means of an elevator or carrier for the transportation of materials in the various industrial fields, wherein it comprises (1) the round stick type chain 2, (2) chain sprocket 3 to guide the round stick type chain 2 in a caterpillar form, (3) the cylinder 6 housing the piston 7 which is operated by air to drive the round stick type chain 2.

The rodless cylinder using a round stick type chain 1 of this invention is advantageous in that (1) it can be extensively applied to the vertical and horizontal transportation of various materials in the industrial fields as well as the transportation of light and heavy materials, (2) it can be safely used, and (3) it can be economically manufactured and marketed in a reasonable price level.

The present disclosure relates to subject matter contained in priority Korean Patent Application No. 2001-37846, filed on Dec. 7, 2001, the contents of which is herein expressly incorporated by reference in its entirety.

What is claimed is:

1. A rodless cylinder using a round stick type chain having the round stick type chain and the chain sprocket which guides the round stick type chain in a caterpillar form, comprising:

said chain sprocket axially formed on either side of a frame consisting of the rodless cylinder to install the round stick type chain in a caterpillar form;

both sides of said round stick type chain connected to a piston within the cylinder on the frame and to a tension adjustment nut on a connector, respectively;

an air inlet and an emerging hole to house the emerging round stick type chain provided on the cylinder cap at both sides of the cylinder where said round stick type chain passes;

a dust seal and packing provided at said emerging hole to maintain the tightness of the inner cylinder;

an exhaust silencer provided at the entrance of the emerging hole for air exhaust; and, said connector guided to a guide bar formed between the frame vertically and selectively linked to a carrier to transport various materials.

* * * * *